US011525198B2

(12) United States Patent
Mueller et al.

(10) Patent No.: US 11,525,198 B2
(45) Date of Patent: Dec. 13, 2022

(54) WARP-KNITTED SPACER FABRIC

(71) Applicants: Stefan Mueller, Wiehl (DE); Joachim Weis, Rauschenberg (DE)

(72) Inventors: Stefan Mueller, Wiehl (DE); Joachim Weis, Rauschenberg (DE)

(73) Assignee: MUELLER TEXTIL GMBH, Wiehl-Drabenderhoehe (DE)

( * ) Notice: Subject to any disclaimer, the term of this patent is extended or adjusted under 35 U.S.C. 154(b) by 428 days.

(21) Appl. No.: 16/744,885

(22) Filed: Jan. 16, 2020

(65) Prior Publication Data

US 2020/0240055 A1 Jul. 30, 2020

(30) Foreign Application Priority Data

Jan. 29, 2019 (DE) ..... 102019102203.7

(51) Int. Cl.
*D04B 21/20* (2006.01)

(52) U.S. Cl.
CPC ..... *D04B 21/20* (2013.01); *D10B 2101/20* (2013.01); *D10B 2331/04* (2013.01); *D10B 2401/16* (2013.01)

(58) Field of Classification Search
CPC ..... D04B 21/20; D10B 2401/16; D10B 2331/04; D10B 2101/20
See application file for complete search history.

(56) References Cited

FOREIGN PATENT DOCUMENTS

| | | | | |
|---|---|---|---|---|
| DE | 9013062 | U | | 3/1991 |
| DE | 19903250 | A | | 8/2000 |
| DE | 102006038612 | | * | 2/2008 |
| DE | 102008034937 | A | | 2/2010 |
| DE | 102009013250 | B | | 7/2010 |
| DE | 102006114778 | A | | 3/2017 |
| DE | 102015114778 | A | | 3/2017 |
| HU | 0000938 | | * | 10/2000 |
| WO | 2012139142 | A | | 10/2012 |

* cited by examiner

*Primary Examiner* — Cephia D Toomer
(74) *Attorney, Agent, or Firm* — Andrew Wilford

(57) ABSTRACT

A spacer fabric has two textile layers and spacer yarns that transversely connect the textile layers and where the yarns forming the textile layers are composed exclusively of a nonmetallic material. In addition, at least a first portion of the spacer yarns is composed of metallic yarn, and a weight of all metallic spacer yarns is between 40 and 96% relative to the total weight of the spacer fabric.

10 Claims, 2 Drawing Sheets

WARP-KNITTED SPACER FABRIC

CROSS REFERENCE TO RELATED APPLICATIONS

This application is related to copending application Ser. No. 16/519,666 filed 23 Jul. 2019 and Ser. No. 16/543,793 filed 19 Aug. 2019.

FIELD OF THE INVENTION

The present invention relates to a spacer fabric. More particularly this invention concerns such a fabric of warp-knitted construction.

BACKGROUND OF THE INVENTION

The present invention relates to a spacer fabric, particularly to a warp-knitted spacer fabric, with two usually substantially flat textile layers and with spacer yarns connecting the textile layers, the yarns forming textile layers exclusively consisting of a nonmetallic material. The nonmetallic material is preferably plastic, with yarns made of glass, carbon, basalt, or natural fibers also being possible. It is crucial, however, that none of the yarns in the textile layers be made of metal, it being preferred for the yarns in the textile layers to be mesh yarns.

In order to enable the spacer yarns to connect the textile layers to one another, they are of course incorporated into the textile layers in a connecting manner. In the case of a spacer fabric in the form of a warp-knitted spacer fabric, the spacer yarns can be worked into the textile layers, for example in the form of stitches. Alternatively, however, it is also possible for the spacer yarns or portions of the spacer yarns to wrap around the yarns of the textile layers. Nevertheless, the spacer yarns are not responsible for the structure of the textile layers, so that they are not to be regarded as part of the textile layers within the scope of the present invention. In particular, the textile layers remain as substantially two-dimensional, coherent textile structures after removal or omission of the spacer yarns.

Spacer fabrics and, in particular, warp-knitted spacer fabrics are characterized by a light, air-permeable structure, with spacer fabrics generally having an elasticity in the direction of their thickness as a result of spacer yarns that run between the two textile layers. By virtue of these properties, warp-knitted spacer fabrics are often provided as a soft, elastic layer that enables air circulation in mattresses, upholstered furniture, garments, or shoes. A warp-knitted spacer fabric of this generic type is known from DE 90 16 062.

In addition to such conventional applications in the consumer sector, spacer fabrics and, in particular, warp-knitted spacer fabrics are frequently also used as technical textiles for highly specialized applications. For instance, warp-knitted spacer fabrics are also used in the automotive industry, for example for climate-controlled seats under the seat covers, with warp-knitted spacer fabrics allowing for good contour adjustment due to their cushioning properties and very good restorative behavior despite the overall low weight per unit area. Warp-knitted spacer fabrics are also used for the interior lining of vehicles, and it is even possible to use them over air bags through the introduction of local weak points. The possible applications of warp-knitted spacer fabrics are not limited to the areas of ventilation and/or elastic support. For instance, it is known from WO 2012/139142 to use warp-knitted spacer fabrics for railway sleepers for connecting a concrete body to a sleeper, the warp-knitted spacer fabric being embedded partially in the concrete body and in the sleeper during the manufacture of the sleeper body, thus enabling the especially reliable, permanent connection of these two elements.

Another known application is the provision of a heating or sensor function, for which purpose wires and, in particular, litz wires are incorporated into the textile structure. Corresponding configurations are known from DE 199 03 070, DE 10 2008 034 937, and DE 10 2009 013 250.

According to DE 10 2015 114 778, a warp-knitted spacer fabric is proposed for heating purposes in which conductive yarns of a flat warp-knitted fabric layer are composed of a plastic multifilament yarn provided with a conductive coating. The multifilament yarn has the advantage that, despite the conductive and, in particular, metallic coating of the individual filaments, it still has relatively good flexibility, thus enabling processing in a knitting process. The conductive yarns are arranged in one of the two flat warp-knitted layers that is usually facing a user.

DE 10 2006 038 612 discloses another warp-knitted spacer fabric provided for heating purposes that, in contrast to DE 10 2015 114 778 A1, contains a proportion of metallic conductive yarns instead of coated multifilament yarn made of plastic, these metallic yarns being embodied as multifilament braided wires. In addition, such braided wires can also be provided for the spacer yarns.

OBJECTS OF THE INVENTION

It is therefore an object of the present invention to provide an improved warp-knitted spacer fabric.

Another object is the provision of such an improved warp-knitted spacer fabric that overcomes the above-given disadvantages, in particular that has a new functionality.

SUMMARY OF THE INVENTION

A spacer fabric according to the invention has two textile layers and spacer yarns that transversely connect the textile layers and where the yarns forming the textile layers are composed exclusively of a nonmetallic material. In addition, at least a first portion of the spacer yarns is composed of metallic yarn, and a weight of all metallic spacer yarns is between 40 and 96% relative to the total weight of the spacer fabric.

In the context of the invention, metallic yarns are all yarns that have at least a metallic core or jacket and are preferably made entirely of metal. However, the metal content is at least 60%, preferably at least 70%.

The invention proceeds here from the realization that the use of metallic spacer yarns enables both heat and electricity to move transversely, in the direction of the spacer yarns, while the textile layers themselves have both a thermally and electrically insulating effect, since they are composed of nonconductive or poorly conductive nonmetallic materials.

Such a spacer fabric is advantageous particularly if electrical components are to be cooled in a housing. For example, if rechargeable batteries, motors, and other electrical components are placed in a housing with an ohmic resistance, the spacer fabric can be used for heat transfer in such installation situations. Optionally, an adhesive, a paste, or the like can be used on the textile layers for better fixation and/or contacting, it being possible even then for thickness compensation or thickness adjustment to be performed by means of the spacer yarns. Different gap dimensions due to production-related fluctuations can be compensated for by the warp-knitted spacer fabric in a particularly advantageous manner, and because of the low weight per unit area compared to known designs, weight savings can often also be achieved. Especially for the described applications, the heat conduction is sufficient despite the overall airy structure.

Finally, applications are also conceivable in which the cooling is improved even further through ventilation of the spacer fabric, so that a cooling by convection or a cooling air flow then also occurs in addition to the heat conduction via the thickness.

In order to ensure a sufficient degree of heat conduction, a provision is also made that the ratio of the weight of all metallic spacer yarns to the total weight (per unit of area) of the spacer fabric is between 40 and 96%. This makes it clear that the spacer yarns make up the majority of the weight of the spacer fabric and decisively determine the total weight of the spacer fabric. This makes it possible for a particularly light structure to be achieved in the textile layers while still achieving good heat transfer in the transverse direction of thickness. The weight of all of the metallic spacer yarns is especially preferably between 60 and 90% relative to the total weight of the spacer fabric.

In principle, all types of yarn can be used as metallic yarn. This is especially preferably a metal wire, but configurations with braided wires or twisted yarns are also conceivable, each of which is composed of a multitude of individual metal wires. In this context, a wire is to be understood as a strand that is not composed of individual sub-elements and therefore has a single, limited cross section. The wire has, for example, a rectangular or round cross-sectional profile.

The metallic spacer yarns usually have a diameter of between 0.03 and 0.3 mm, particularly between 0.05 and 0.1 mm. Such a diameter range ensures, on the one hand, that sufficient thermal and/or electrical conduction can take place within the framework of conventional materials and that, on the other hand, the bends in the metallic yarn that occur during stitch formation in a warp-knitted spacer fabric do not result in breakage of the material. Copper or a copper alloy is preferably provided as the material for the metallic yarn, with brass in particular having been found to be especially advantageous. Brass is a copper alloy consisting of copper and zinc, with the weight fraction of zinc being up to 40%.

In a preferred development of the invention, nonmetallic spacer yarns are also provided in addition to the metallic spacer yarns. These spacer yarns form a second portion of the spacer yarns, the second portion of the spacer yarns being preferably composed of a monofilament made of plastic. However, it also lies within the scope of the invention for a multifilament yarn composed of plastic to be used instead of a monofilament, such a plastic multifilament yarn being substantially softer and more flexible than a monofilament with the same fineness. Instead of plastic, yarns in the form of mono- or multifilaments that are composed of glass, carbon, basalt, or natural fibers can also be employed.

By integrating nonmetallic spacer yarns, a higher degree of elasticity is imparted to the spacer fabric than would be the case if only metallic spacer yarns were used. For example, if pressure is exerted on the textile layers from the outside, this leads to bending of the spacer yarns. Due to the easy plastic deformability of metal, this would normally result in permanent plastic deformation of the spacer fabric. The use of additional nonmetallic spacer yarns can prevent this to a certain extent.

In addition, the electrical and/or the thermal conductivity of the spacer fabric can also be specifically adjusted via the ratio of the metallic spacer yarns to the nonmetallic spacer yarns. The ratio of the number of metallic spacer yarns to the number of nonmetallic spacer yarns is between 1:5 and 5:1, preferably between 1:2 and 2:1. Such conditions are especially easy to set in a warp-knitted spacer fabric if two guide bars are used to form the spacer yarns, for example. These guide bars contain a large number of warp guides that are usually embodied as guide needles. A first guide bar is provided for the metallic spacer yarns and a second guide bar is provided for the nonmetallic spacer yarns. A ratio of 1:1 can then be achieved by providing all of the warp guides of the two guide bars with a corresponding spacer yarn. At a ratio of 2:1, the warp guides of the guide bar for the metallic spacer yarns are then completely occupied, while only every other warp guide is occupied in the guide bar for the nonmetallic spacer yarns. Because of the two guide bars, this is also referred to as a 2-yarn system for forming the spacer yarns.

In order to form the textile layers, a 1-yarn or 2-yarn system can be provided for a warp-knitted spacer fabric, depending on the selected knitting pattern. In this case, either one or two guide bars are then occupied with a yarn composed of a nonmetallic material for each textile layer. It is generally sufficient for the spacer fabric according to the invention if only one guide bar is used per textile layer, but the structure of the textile layers can be influenced with regard to the required strength or elongation values by incorporating a second yarn in a second guide bar. This also applies accordingly to the allocation of the guide bars for the textile layers. All in all, the spacer fabric can thus usually be produced in a 4-yarn, 5-yarn or 6-yarn system, with yarn systems beyond these also being possible.

Polyethylene terephthalate (PET) is preferably provided as the plastic material for the spacer yarns and the yarns of the textile layer, although other plastics such as polyolefins, polyamide, or the like can also be used. The fineness of the plastic spacer yarns is between 20 dtex and 950 dtex, preferably between 40 dtex and 240 dtex. In contrast, the mesh yarns forming the textile layers have a fineness in the range from 20 dtex to 180 dtex, preferably in the range from 30 dtex to 80 dtex.

A value of 950 dtex corresponds to a diameter of approximately 0.3 mm for polyethylene terephthalate as the material. When using spacer yarns with such a degree of fineness, the diameter of the second portion of the spacer yarns approximately corresponds to the maximum diameter of the metal wire. In addition, the diameter of the metallic spacer yarns and the diameter of the nonmetallic spacer yarns can also differ from one another. This is particularly useful if a large number of metallic spacer yarns are used in comparison to the number of nonmetallic spacer yarns. This can ensure that the use of correspondingly thinner metallic yarns continues to exert a sufficient elastic restorative force on the spacer fabric from the nonmetallic spacer yarns.

The thickness of the spacer yarns can also be the result of an optimization. For example, as the thickness of the metallic yarn increases, it becomes more difficult to process it using conventional machines. Moreover, the restorative forces of the nonmetallic spacer yarns decrease as the diameter decreases.

Conversely, it is also possible for the nonmetallic spacer yarns to be made thinner than the metallic spacer yarns. This usually serves the function of setting the thermal and/or electrical conductivity of the spacer fabric. In addition to the ratio of the number of metallic spacer yarns to the number of nonmetallic spacer yarns, the thickness or the fineness of the individual spacer yarns relative to one another thus represents an important variable by means of which the electrical and/or thermal conductivity can be set.

As a matter of principle, the metallic yarn can be used directly for the spacer yarns without any further treatment or modification. In a preferred development, however, the spacer yarns composed of metal have a coating or cover layer that surrounds the metallic yarn and is preferably composed of a thermally and/or electrically conductive material. This makes it possible for long-term corrosion protection to be achieved with a wrapping that is composed substantially of copper while not significantly influencing the thermal and/or the electrical conductivity. In this context, tin has proven to be particularly advantageous for the cover layer.

In principle, however, it also lies within the scope of the invention for electrically or thermally non-conductive or only poorly conductive materials to be used as cover layers, provided that effective corrosion protection can still be ensured.

In addition to a coating, painting in particular has been found to be especially advantageous, since it can be carried out at little expense. With the aid of a cover layer, the running properties of the metallic yarn during the manufacturing process—in a knitting machine, for example—can also be improved through appropriate selection of material.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
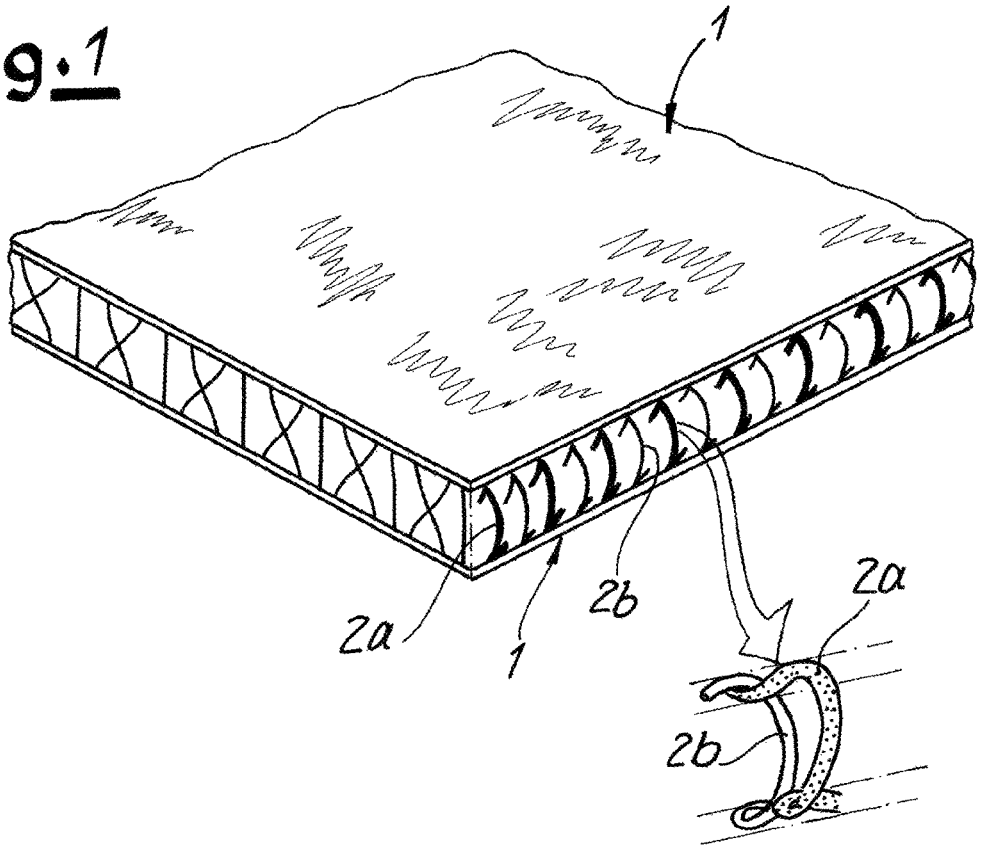
FIG. 1 shows a warp-knitted spacer fabric according to the invention.
Figure 2:
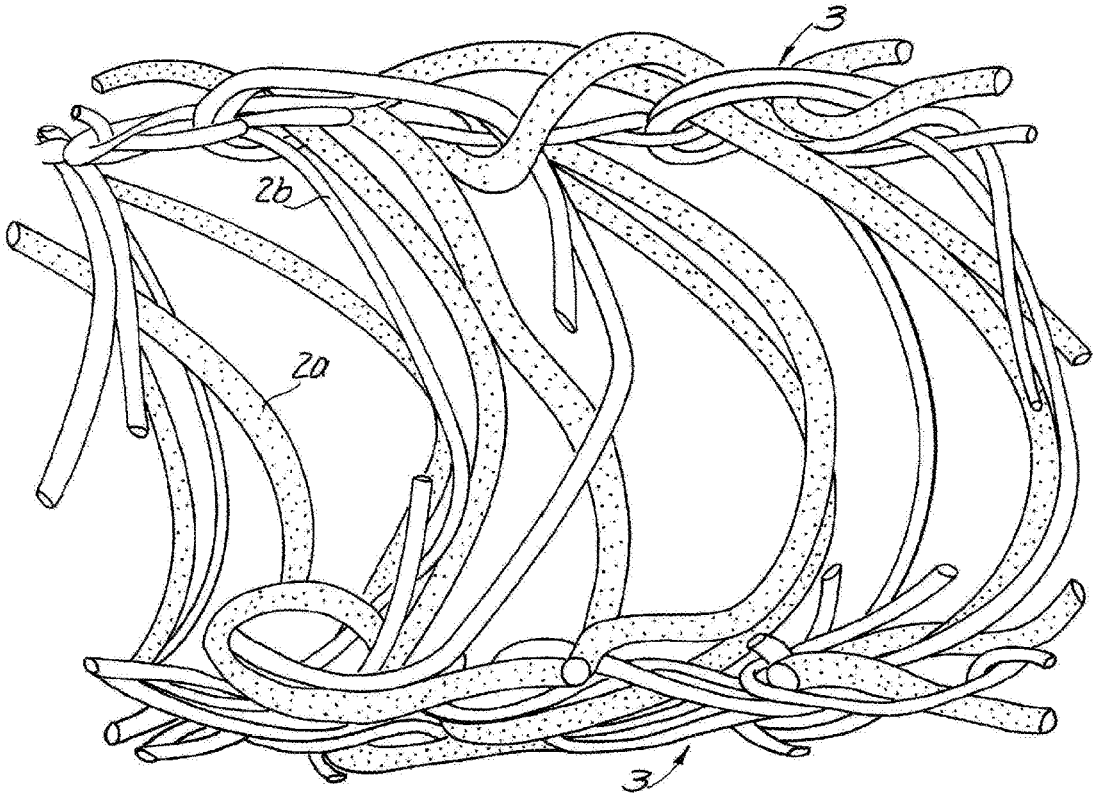
FIG. 2 is a detailed view of the warp-knitted spacer fabric according to FIG. 1.

FIG. 1 shows a warp-knitted spacer fabric with two textile layers 1 and spacer yarns 2*a* and 2*b* that transversely interconnect the textile layers 1. Both FIG. 1 and in particular the detail view of FIG. 2 show that the spacer yarns 2*a* and 2*b* are different. A first portion of the spacer yarns 2*a* is composed of a metallic yarn, with a brass metal wire being used in this case. In principle, however, the invention is not restricted to such an embodiment. In particular, metallic multifilaments or even metal strands can also be used. In addition, both copper and various types of copper alloy can be used as the material.

A second portion of the spacer yarns 2*b* is not composed of metallic yarn, but of a monofilament made of plastic. Unlike metallic yarn, monofilaments made of plastic provide much greater restorative forces due to their deflection, so that the spacer fabric, in contrast to an embodiment with spacer yarns composed only of metal 2*a*, results in a substantially more elastic behavior of the warp-knitted spacer fabric. Polyethylene terephthalate (PET) is usually used as the plastic, but other typical materials such as various polyolefins, polyamide, and the like can also be employed.

The mesh yarns 3 shown in FIG. 2 that form the textile layers 1 are composed exclusively of plastic, so the same materials can be used as for the plastic spacer yarns 2*b*.

Accordingly, the textile layers 1 are transiently composed of polyethylene terephthalate. According to the invention, the metallic yarn is therefore used only for the spacer yarns 2*a*, so that high thermal and/or electrical conductivity is produced in the direction of thickness of the warp-knitted spacer fabric or in the direction the textile layers 1 are spaced from each other. The formation of the textile layers 1 exclusively from mesh yarns composed of plastic, on the other hand, results in near perfect thermal and/or electrical insulation in the direction of their parallel planes.

Although the number of metallic spacer yarns 2*a* is comparatively small relative to all spacer and mesh yarns, these are decisively determinative for the total weight of the warp-knitted spacer fabric due to their high density. For instance, in the warp-knitted spacer fabric shown in FIGS. 1 and 2, the portion of all of the metallic spacer yarns 2*a* constitutes 90% of the weight relative to the total weight of the warp-knitted spacer fabric.

The weight of the warp-knitted spacer fabric can be determined on the one hand by the number and on the other hand by the thickness of the metallic spacer yarns 2*a*. In the embodiment shown in FIG. 2, the metal wires used as metallic yarns have a diameter of 0.2 mm. The fineness of the plastic monofilament for the plastic spacer yarns 2*b* is 240 dtex. The mesh yarns 3 of the textile layers 1 have a fineness of 76 dtex. However, these numbers are merely exemplary; for example, it is also possible for the diameter of the metallic yarns to be reduced while the fineness of the metallic yarns 3 and/or plastic spacer yarns 2*b* to be increased, in which case the weight proportion of the metallic yarn decreases overall.

Figure 3A:
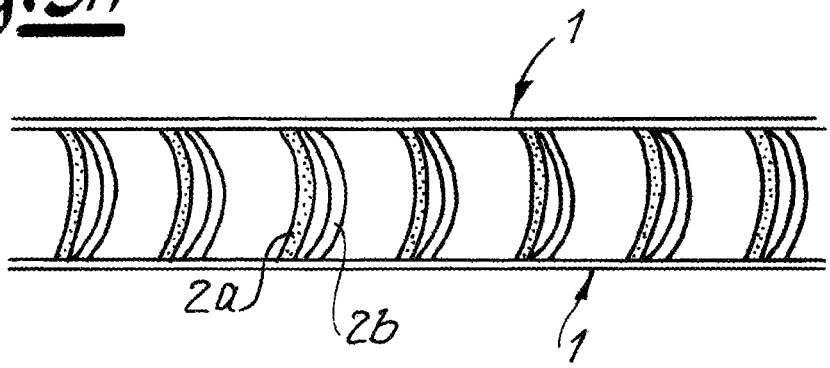
FIGS. 3A to 3D show the warp-knitted spacer fabric according to the invention in a cross section with spacer yarns guided in different manners.

As already mentioned above, the electrical and/or thermal conductivity and also the elastic behavior of the spacer fabric can be set in a targeted manner via the ratio of the metallic spacer yarns 2*a* to the plastic spacer yarns 2*b*. This can be achieved in a knitting process by using two different guide bars for the spacer yarn composed of metallic yarn 2*a* and for the spacer yarn composed of plastic 2*b*. These guide bars have a multitude of warp guides that are arranged next to one another, each warp guide carrying a single yarn. It is therefore possible not to place a yarn on every warp guide; for example, a yarn can be provided only on every other yarn. A ratio of the metallic spacer yarns 2*a* to the plastic spacer yarns 2*b* of 1:1 is achieved, for example, by covering each warp guide of the two guide bars with a corresponding metallic yarn or monofilament made of polyethylene terephthalate. An example of such an embodiment is shown in FIG. 3*a*. As an alternative, it is also possible even with the ratio remaining the same for only every other warp guide to be occupied alternately both in the guide bars for the metallic spacer yarns 2*a* and in the guide bar for the plastic spacer yarns 2*b*, so that the individual spacer yarns 2*a* and 2*b* alternate so as to be spaced apart from one another.

Figure 3B:
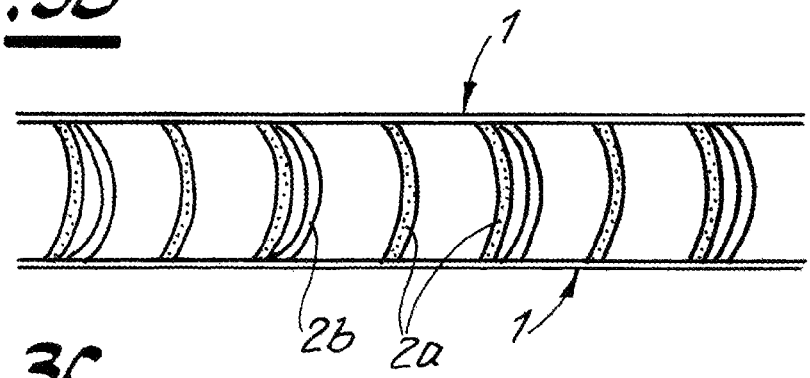
Figure 3C:
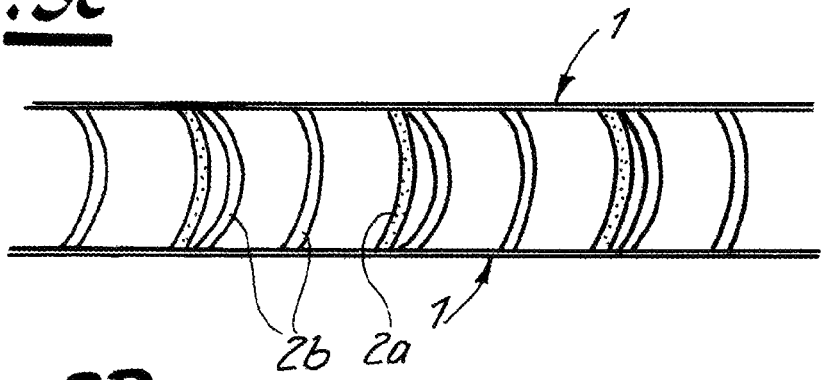
Figure 3D:
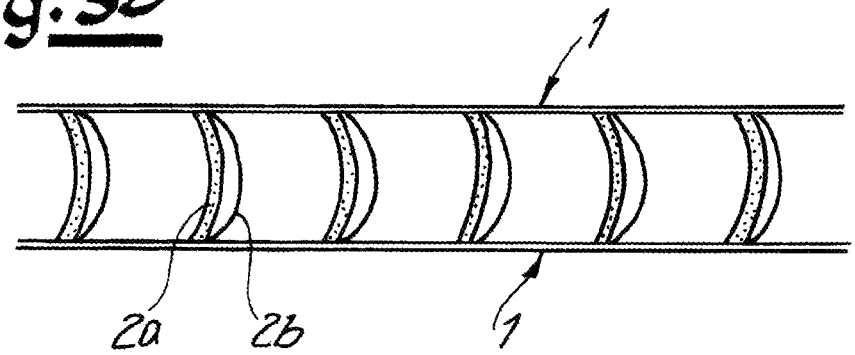

FIGS. 3B to 3D show embodiments that differ from this. For example, in the warp-knitted spacer fabric shown in FIG. 3B, only every other warp guide is occupied with a spacer yarn composed of plastic 2*b*, whereas the warp guides of the guide bar for the metallic spacer yarns 2*a* are all occupied.

A configuration that is inverted in this respect is shown in FIG. 3C, in which only every other warp guide is occupied with a metallic yarn.

FIG. 3D shows an embodiment in which both guide bars for the spacer yarns 3*a*, 3*b* are completely occupied. However, the thickness of the metallic yarn used for the spacer yarns composed of metal 2*a* is substantially greater than the thickness of the plastic spacer yarns 2*b*, so that, in terms of weight, a similar effect is achieved as with a numerical reduction of the plastic spacer yarns 2*b* according to FIG. 3B.

The laying patterns shown as examples for a warp-knitted spacer fabric can in principle also be used for other spacer fabrics and are not limited to warp-knitted spacer fabrics.

We claim:

1. In a spacer fabric with two textile layers and spacer yarns that transversely connect the textile layers and where the yarns forming the textile layers are composed exclusively of a nonmetallic material, the improvement wherein at least a first portion of the spacer yarns is composed of metallic spacer yarns, a second portion of the spacer yarns is composed of nonmetallic polyethylene terephthalate, polyolefin, and/or polyamide spacer yarns, and a weight of all metallic spacer yarns is between 40 and 96% relative to the total weight of the spacer fabric.

2. The spacer fabric according to claim 1, wherein the weight of all of the metallic spacer yarns is between 60 and 90% relative to the total weight per unit of area of the fabric.

3. The spacer fabric according to claim 1, wherein the metallic spacer yarns are a metal wires.

4. The spacer fabric according to claim 1, wherein the metallic spacer yarns each have a diameter of between 0.03 and 0.3 mm.

5. The spacer fabric according to claim 1, wherein spacer yarns the second portion have a fineness in the range from 22 dtex to 950 dtex.

6. The spacer fabric according to claim 1, wherein the textile layers are formed by warp knitting.

7. The spacer fabric according to claim 1, wherein a ratio of the number of metallic spacer yarns to the number of nonmetallic spacer yarns is between 1:5 and 5:1.

8. The spacer fabric according to claim 1, wherein the metallic spacer yarns are composed of copper or a copper alloy.

9. The spacer fabric according to claim 1, wherein the metallic spacer yarns have a nonconductive core covered with a conductive coating.

10. The spacer fabric according to claim 1, wherein the fabric has a total thickness measured transversely of the textile layers of between 1 mm and 20 mm.

* * * * *